US010276081B2

(12) United States Patent
Ong et al.

(10) Patent No.: US 10,276,081 B2
(45) Date of Patent: Apr. 30, 2019

(54) DISPLAY DEVICE WITH COLOR AND LUMINANCE CHARACTERIZATION AND COMPENSATION METHODS

(71) Applicant: Dell Products L.P., Round Rock, TX (US)

(72) Inventors: Aik Keong Ong, Singapore (SG); Andrew Khor, Singapore (SG)

(73) Assignee: Dell Products L.P., Round Rock, TX (US)

( * ) Notice: Subject to any disclaimer, the term of this patent is extended or adjusted under 35 U.S.C. 154(b) by 114 days.

(21) Appl. No.: 15/471,901

(22) Filed: Mar. 28, 2017

(65) Prior Publication Data

US 2018/0286297 A1 Oct. 4, 2018

(51) Int. Cl.
*G09G 3/20* (2006.01)
*G09G 3/36* (2006.01)

(52) U.S. Cl.
CPC ..... *G09G 3/2003* (2013.01); *G09G 3/36* (2013.01); *G09G 2320/0626* (2013.01); *G09G 2320/0666* (2013.01); *G09G 2360/144* (2013.01)

(58) Field of Classification Search
CPC ..... G09G 3/2003; G09G 3/36; G09G 2320/0626; G09G 2320/0666; G09G 2360/144
See application file for complete search history.

(56) References Cited

U.S. PATENT DOCUMENTS

| | | | | |
|---|---|---|---|---|
| 4,379,292 | A | 4/1983 | Minato et al. | |
| 7,737,989 | B2 | 6/2010 | Pettitt et al. | |
| 8,207,955 | B2 | 6/2012 | Morimoto | |
| 9,645,386 | B2 * | 5/2017 | Lau | G02B 26/00 |
| 2005/0231457 | A1 * | 10/2005 | Yamamoto | G09G 3/3413 345/102 |
| 2006/0262147 | A1 * | 11/2006 | Kimpe | G09G 3/20 345/690 |
| 2009/0237572 | A1 * | 9/2009 | Kishimoto | G02F 1/13318 348/734 |

(Continued)

OTHER PUBLICATIONS

Ams, "XYZ Tristimulus Color Sensor", TCS3430, 2016, 2 pgs.

(Continued)

*Primary Examiner* — Ricardo Osorio
(74) *Attorney, Agent, or Firm* — Egan Peterman Enders Huston

(57) ABSTRACT

Improved display devices, information handling systems and related methods are provided for color and luminance characterization and compensation. According to one embodiment, a characterization method is provided for correlating the color/luminance measured from light emitted by a light source disposed within the display device to the color/luminance measured from light output from the display device at the time of manufacture. After the display device is characterized and a set of characterization values are stored, a compensation method is used during operation of the display device to perform color/luminance compensation for the light output from the display device by measuring the color/luminance of the light source illumination, and adjusting color gain values to maintain the color/luminance of the output light at a reference set point.

20 Claims, 6 Drawing Sheets

(56) References Cited

U.S. PATENT DOCUMENTS

| | | | | |
|---|---|---|---|---|
| 2010/0117941 | A1* | 5/2010 | Schulz | G09G 3/3413 345/88 |
| 2012/0105402 | A1* | 5/2012 | Huang | G09G 3/3406 345/207 |
| 2014/0049527 | A1 | 2/2014 | Lanzoni et al. | |
| 2016/0225301 | A1* | 8/2016 | Scepanovic | G09G 3/32 |
| 2017/0092187 | A1* | 3/2017 | Bergquist | G09G 3/20 |
| 2017/0134625 | A1* | 5/2017 | Salazar | G06T 7/408 |

OTHER PUBLICATIONS

Wikipedia, DIE 1931 Color Space, Printed from Internet on Feb. 20, 2017, 11 pgs.
Wikipedia, "Color Balance", Printed from Internet on Feb. 20, 2017, 4 pgs.
Eizo, "Color Management Monitors", Color Edge, 2016, 13 pgs.
Wikipedia, "Colorimetry", Printed from Internet on Feb. 20, 2017, 3 pgs.
Jencolor, Application Report, "Improved LED Systems With True Color Sensors", 2008, 10 pgs.
Wikipedia, "Spectroradiometer", Printed from Internet on Feb. 20, 2017, 5 pgs.

* cited by examiner

DISPLAY DEVICE WITH COLOR AND LUMINANCE CHARACTERIZATION AND COMPENSATION METHODS

FIELD

This application relates to display devices and/or information handling systems with display devices, and more particularly to display devices, information handling systems and related methods for color and luminance characterization and compensation.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems typically utilize a display device to provide visual output related to operations occurring within and/or being performed by the information handling system. Depending on the type of information handling system, the display device can be physically connected or affixed to the system, or may be communicatively connected to the system via one or more cables and/or intermediary components (e.g., a docking station). Of the various types of display devices that can be provided with different information handling systems, perhaps the most common type of display device in use today is a liquid crystal display (LCD) device. LCDs are generally configured with a glass display screen, a color filter, a liquid crystal display panel of (color) pixels, and a backlight panel that illuminates the pixels to create an image on the display screen. The backlight panel includes a light source (e.g., a pair of cold cathode fluorescent lamps, CCFLs, or a plurality of light emitting diodes, LEDs), which may be driven to emit light that is transmitted and/or reflected through the LCD panel and color filter, and output from the display screen of the display device.

Over time, and during use of the display device, the color and luminance (i.e., the brightness perceived by a human observer) of the light output from the display device may drift from desired set point(s), such as a desired white balance and/or a desired luminance set point. In some cases, the changes in color and/or luminance over time (and other operating conditions) may be readily apparent to the human observer, and/or may be undesirable for certain image display applications, which require and/or benefit from consistently accurate color and luminance reproduction.

SUMMARY

The following description of various embodiments of display devices, systems and methods is not to be construed in any way as limiting the subject matter of the appended claims.

Generally speaking, the present disclosure provides improved display devices, information handling systems and related methods that may be used to maintain consistent color and luminance over changes in operating conditions and lifetime of the display device. More specifically, the present disclosure provides a characterization method, which correlates the color/luminance measured from the light emitted by a light source disposed within the display device to the color/luminance measured from the light output from the display device at the time of manufacture. After the display device is characterized and a set of characterization values are stored within the display device (or within the information handling system), a compensation method is used during operation of the display device to perform color/luminance correction for the light output from the display device by repeatedly measuring the color/luminance of the light source illumination, and adjusting color gain values to maintain the color/luminance of the output light at a reference set point.

According to one embodiment, a method for characterizing a display device may generally begin by driving a light source of the display device to emit light at a reference set point. Once the light source is driven to emit light, the method may obtain a first set of color values corresponding to the light emitted by the light source, and a second set of color values corresponding to light output from the display device. The first set of color values are obtained from a light sensor disposed within the display device for receiving the emitted light, and the second set of color values are obtained from a light analyzer disposed outside of the display device for receiving the output light.

In general, the first set of color values and the second set of color values may be obtained in substantially any color space including, but not limited to, the CIE 1931 XYZ color space, the CIE 1931 xyY color space, the CIE 1931 RGB color space, the CIE 1976 LUV color space, and various other color spaces (e.g., sRGB, Adobe RGB, etc.). In some embodiments, the first set of color values and the second set of color values may include color values within the same color space. In one exemplary embodiment, the first and second sets of color values may include XYZ tristimulus values. In another exemplary embodiment, the first and second sets of color values may include RGB color values. However, the first and second sets of color values are not limited to such color spaces or values. In other embodiments, the first set of color values may include color values within a first color space, and the second set of color values may include color values within a second color space different from the first color space.

Once the first and second sets of color values are obtained, the method may generate a set of characterization values, which correlate the first set of color values to the second set of color values at the reference set point. In some embodiments, the step of generating a set of characterization values may include dividing the second set of color values by the first set of color values. The generated set of characterization values may then be stored, for example, within a storage medium of the display device (or the information handling system).

In some embodiments, the steps of driving a light source, obtaining a first set of color values, obtaining a second set of color values, generating a set of characterization values and storing the set of characterization values may be performed during manufacturing of the display device to characterize the light output by the display device at the reference set point (e.g., a white balance set point, a red set point, a green set point or a blue set point). In some embodiments, the steps of driving a light source, obtaining a first set of color values, obtaining a second set of color values, generating a set of display device characterization values and storing the set of characterization values may be repeated for a plurality of different reference set points.

According to another embodiment, a compensation method for maintaining a color and a luminance of light output from a display device over time may generally begin by driving a light source of the display device to emit light at a reference set point. Once the light source is driven to emit light, the method may obtain a first set of color values corresponding to the light emitted by the light source, and may calculate a second set of color values corresponding to the light output from the display device. The first set of color values may be obtained from a light sensor, which is disposed within the display device for receiving the emitted light. The second set of color values may be calculated by combining the first set of color values with a set of characterization values, which were previously determined during manufacturing of the display device and stored (e.g., within a storage medium of the display device or information handling system).

In general, the first set of color values and the second set of color values may be obtained/calculated within substantially any color space including, but not limited to, the CIE 1931 XYZ color space, the CIE 1931 xyY color space, the CIE 1931 RGB color space, the CIE 1976 LUV color space, and various other color spaces (e.g., sRGB, Adobe RGB, etc.). However, it is generally desired that the compensation method obtains/calculates color values within the same color space(s), which were used in the characterization method to generate the set of characterization values.

In some embodiments, the stored set of display device characterization values may have been previously determined by dividing a fifth set of color values by a fourth set of color values. The fourth set of color values are values, which were previously obtained from a light sensor disposed within the display device upon receiving light emitted from a light source of the display device at the reference set point. The fifth set of color values are values, which were previously obtained from a light analyzer disposed outside of the display device for receiving light output from the display device. In some embodiments, the first, second, fourth and fifth sets of color values may include color values within the same color space. In one exemplary embodiment, the first, second, fourth and fifth sets of color values sets of color values may include XYZ tristimulus values. In one exemplary embodiment, the first, second, fourth and fifth sets of color values sets of color values may include RGB color values. However, the first, second, fourth and fifth sets of color values are not limited to such color spaces or values. In other embodiments, the first set of color values and the fourth set of color values may include color values within a first color space, while the second set of color values and the fifth set of color values comprise color values within a second color space different from the first color space.

Once a second set of color values is calculated, the method may derive a set of gain values from the second set of color values and a third set of color values corresponding to the reference set point, and may use the set of gain values to maintain the color and the luminance of the light output from the display device at the reference set point. In some embodiments, the steps of driving, obtaining, calculating, deriving and using may be performed repeatedly over time during operation of the display device to maintain the color and the luminance of the light output from the display device at the reference set point (e.g., a white balance set point, a red set point, a green set point or a blue set point). In some embodiments, the reference set point may be changed to a new reference set point, and the steps of driving, obtaining, calculating, deriving and using may be repeated to change the color and the luminance of the light output from the display device to the new reference set point.

According to another embodiment, a system is provided herein as comprising a light source, a display panel, a light sensor, a processing device and driver circuitry. In one embodiment, the system is a display device and the processing device is a display controller. In such an embodiment, the display device may be a stand-alone display device, which is communicably coupled to an information handling system. In another embodiment, the system is an information handling system and the processing device is a central processing unit (CPU), graphics processing unit (GPU), display controller, or other processing device of the information handling system. In such an embodiment, the system may include a display device, which is a stand-alone display device that is communicably coupled to the information handling system, or a display device that is permanently or detachably affixed to the information handling system.

The light source may be disposed within the display device and may be configured to emit light at a reference set point (e.g., a white balance set point, a red set point, a green set point or a blue set point). The display panel may be arranged above the light source for receiving the light emitted by the light source, and may be configured for generating images for display on a display screen of the display device. The light sensor may also be coupled to receive the light emitted from the light source, and may be configured to generate a first set of color values corresponding to the emitted light. In some embodiments, the light sensor may be a single light sensor, which is arranged behind the light source near a center point of the display panel. In other embodiments, the light sensor may comprise a plurality of light sensors, each arranged behind the light source and centered behind a different section of the display panel.

The processing device (e.g., a CPU, GPU or display controller) may be coupled to receive the first set of color values from the light sensor(s), and may be configured to calculate a second set of color values corresponding to light output from the system (e.g., the display device or information handling system) by combining the first set of color values with a stored set of characterization values. The processing device may then derive a set of gain values from the second set of color values and a third set of color values corresponding to the reference set point. The driver circuitry may be coupled to the light source and to the processing device, and may be configured to use the set of gain values to alter a drive signal supplied to the light source, so as to maintain a color and a luminance of the light output from the system at the reference set point.

As noted above, the set of characterization values may be predetermined during manufacturing of the system. In some embodiments, the set of characterization values may be stored within a storage medium of the system. In some embodiments, the stored set of characterization values may be predetermined by dividing a fifth set of color values by a fourth set of color values. The fourth set of color values are values, which were previously obtained from a light sensor disposed within the display device upon receiving light emitted from a light source of the display device at the reference set point. The fifth set of color values are values, which were previously obtained from a light analyzer disposed outside of the display device for receiving light output from the display device.

In some embodiments, the first, second, fourth and fifth sets of color values may include color values within the same color space. In one exemplary embodiment, the first, second, fourth and fifth sets of color values sets of color values may include XYZ tristimulus values. In such an embodiment, the light sensor disposed within the display device may be a XYZ tristimulus colorimeter, which is configured for providing the first and fourth sets of color values as a set of XYZ tristimulus values, or as (x,y) chromaticity coordinates and a Y tristimulus value that is convertible into a set of XYZ tristimulus values. The light sensor may be implemented differently in other embodiments.

BRIEF DESCRIPTION OF THE DRAWINGS

Other advantages of the invention will become apparent upon reading the following detailed description and upon reference to the accompanying drawings in which.

Figure 1:
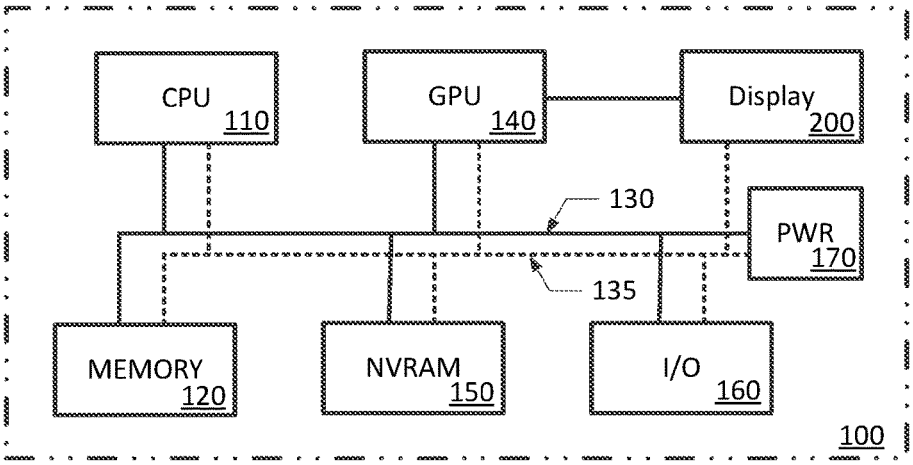
FIG. 1 is a simplified block diagram illustrating one example of an information handling system comprising a display device in accordance with the embodiments disclosed herein.

While the present disclosure is susceptible to various modifications and alternative forms, specific embodiments thereof are shown by way of example in the drawings and will herein be described in detail. It should be understood, however, that the drawings and detailed description thereto are not intended to limit the disclosure to the particular form disclosed, but on the contrary, the present disclosure is to cover all modifications, equivalents and alternatives falling within the spirit and scope of the present disclosure as defined by the appended claims.

DESCRIPTION OF ILLUSTRATIVE EMBODIMENTS

This disclosure generally relates to display devices and related methods for characterizing a display device at the time of manufacture, and thereafter, for controlling a light source of the display device, so as to maintain a desired color and luminance of the light output from the display device over time and other operating conditions. The display device described herein may be part of, or configured for use with, a variety of different information handling systems.

For purposes of this disclosure, an information handling system, such as information handling system 100 shown in FIG. 1, may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touch screen and/or a video display. The information handling system may also include one or more buses operable to transmit communications between the various hardware components.

With reference now to FIG. 1, there is depicted a block diagram representing a generalized embodiment of an information handling system 100 comprising and/or communicatively coupled to a display device 200. As depicted in FIG. 1, information handling system 100 may generally include one or more information handling resources. The information handling resources may include any component, system, device or apparatus of information handling system 100, including without limitation processors, busses, computer-readable media, input-output devices and/or interfaces, storage resources, network interfaces, motherboards, electro-mechanical devices (e.g., fans), and/or power supplies.

In the generalized embodiment shown in FIG. 1, information handling system 100 includes at least one central processing unit (CPU) 110, which is coupled to system memory 120 via system interconnect 130 (otherwise referred to as a system bus). Also coupled to CPU 110, via system interconnect 130, is a graphics card with a graphics processing unit (GPU) 140 located thereon, nonvolatile storage (NVRAM) 150, and one or more input/output devices 160. Input/output devices 160 may include, but are certainly not limited to, keyboards, mice, touch pads, touch screens, speakers, and cameras.

Information handling system 100 requires a power source to operate the various electronic components disposed therein. The power source can be provided via an external power source (e.g., mains power) and an internal power supply regulator, and/or by an internal power source, such as a battery. As shown in FIG. 1, power management system 170 may be included within information handling system 100 for moderating the available power from the power source. The power management system 170 may be coupled to one or more components of the information handling system 100 via a power bus 135 to provide the required power, as well as to perform other power-related administrative tasks of the information handling system.

System memory 120 and/or NVRAM 150 may be generally configured to store software and/or firmware modules and one or more sets of data that can be utilized during operation of information handling system 100. In some embodiments, one or more of these software and/or firmware modules can be loaded into system memory 120 from NVRAM 150 during operation of system 100. In one embodiment, system memory 120 may include, or may be loaded with, a plurality of such modules, including one or more firmware (FW) modules, a basic input/output system (BIOS), an operating system (OS), and one or more user application(s). These software and/or firmware modules have varying functionality when their corresponding program code is executed by a main processing device (e.g., CPU 110) or a secondary processing device (e.g., GPU 140) of information handling system 100.

As noted above, information handling system 100 also includes a display device 200, which may be a part of, or communicatively coupled to, the information handling system 100. For example, display device 200 may be permanently or detachably affixed to the information handling system 100, when system 100 is a laptop computer, tablet computer, "2 in 1" system or a mobile device. Alternatively, display device 200 may be a stand-alone display device, which is communicatively coupled to information handling system 100 via one or more cables and/or other interfaces (such as a docking station), when system 100 is a desktop computer. Regardless of whether the display device is a stand-alone device, or integrated with the information handling system 100, display device 200 may be coupled to receive data signals and/or display configuration settings from a processing device (e.g., CPU 110 or GPU 140) of system 110, and may be further coupled to receive power from the power management system 170 within system 100.

As shown in FIG. 1, display device 200 may be communicatively coupled to CPU 110 and/or GPU 140 for receiving data signals and/or display configuration settings. In one embodiment, GPU 140 may include a software or firmware module that can be utilized to configure display configuration settings such as, for example, a white balance set point and/or luminance set point for displaying images on a display screen of the display device 200. The white balance set point and/or the luminance set point may be factory default settings provided by the manufacturer of the display device, and/or may be display configuration settings that can be adjusted by a user. In one embodiment, GPU 140 may supply the data signals and the display configuration settings to the display device 200. In some embodiments, a user may make adjustments to the factory default display configuration settings, or to the currently applied display configuration settings, via an input/output device 160 of the information handling system 100, or one or more user-actuated buttons (not shown) provided on a chassis of the information handling system. In such embodiments, GPU 140 may receive the user selected display configuration settings via system interconnect 130, and may forward the user selected settings onto the display device 200.

In another embodiment, the software or firmware module used to configure or adjust display configuration settings, such as a white balance set point and/or a luminance set point, may be provided within display device 200. In such an embodiment, a user may make adjustments to the factory default display configuration settings, or to the currently applied display configuration settings, via one or more user-actuated buttons (e.g., power and control buttons 265 of FIGS. 2A and 2B) provided on the display device 200.

Figure 2A:
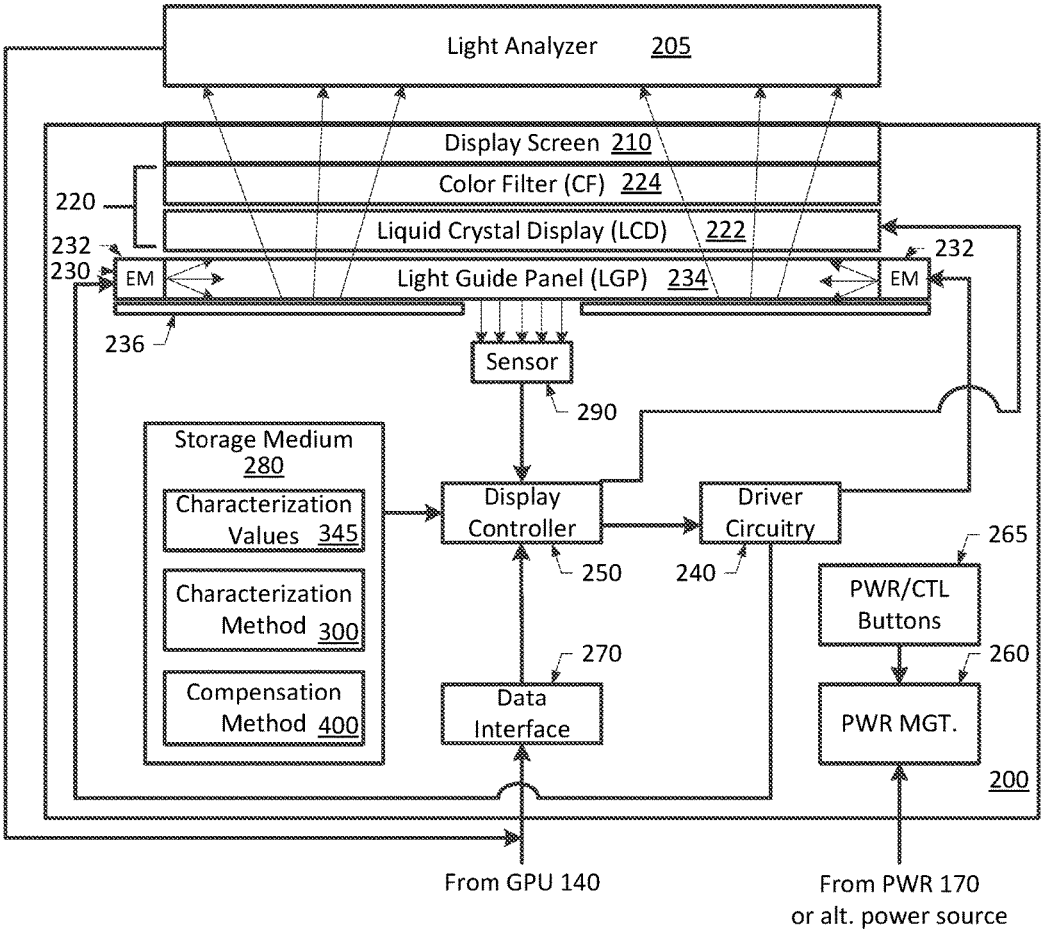
FIG. 2A is a simplified block diagram illustrating one embodiment of an exemplary display device.
Figure 2B:
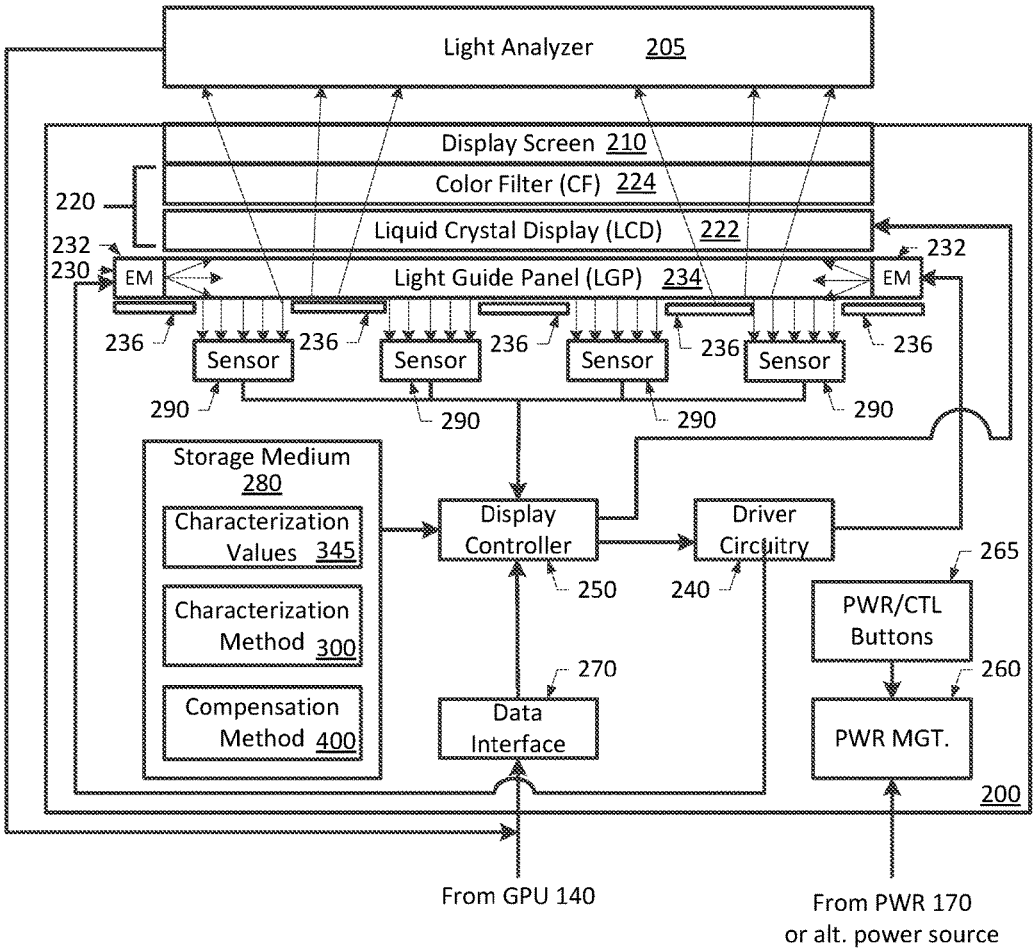
FIG. 2B is a simplified block diagram illustrating another embodiment of an exemplary display device.

FIGS. 2A and 2B are simplified block diagrams illustrating a display device 200, which is configured to operate in accordance with one or more embodiments of the present disclosure. According to one embodiment, display device 200 may include a display panel 220 for displaying images on a display screen 210, a backlight panel 230 comprising a backlight source 232 for illuminating the display panel 220, driver circuitry 240 for supplying voltage or current to the backlight source 232, and a display controller 250 for controlling operation of the display device. In some embodiments, the display screen may be an upper glass substrate of the display panel 220, or may be an additional glass substrate provided for design or protection purposes, or to implement touch screen functionality. Display device 200 also includes a device power module 260, one or more power and control buttons 265 and a data interface 270.

Device power module 260 provides power management for the display device, and may be coupled for receiving power from a power management system 170 of the information handling system 100, an external power source, or an internal power source (such as a battery). Power and control buttons 265 may include one or more user-actuated buttons for turning display device 200 or information handling system 100 on/off, and/or for setting or adjusting one or more display configuration settings. Display device 200 further includes a data interface 270, which may be communicatively coupled for receiving data signals and/or display configuration settings from a processing device of the information handling system (e.g., from CPU 110 or GPU 140 of FIG. 1). The data signals and/or display configuration settings received via the data interface 270 may be forwarded to the display controller 250 for displaying images or video content on the display screen 210 and controlling operations of the display device.

Display controller 250 may use the data signals to display images or video content on the display device by supplying appropriate control signals to display panel 220 and driver circuitry 240. Upon receiving control signals from display controller 250, driver circuitry 240 may supply a drive current to backlight panel 230 for providing backlight illumination to display panel 220. Display controller 250 may control color characteristics of the displayed images or video content by selectively altering one or more pixels of the display panel 220 to control the amount of backlight that passes through the pixels according to specified red, green and blue (RGB) gain settings.

Display controller 250 may further control the amount of backlight that passes through the pixels in accordance with one or more display configuration settings such as, for example, a white balance set point and/or a luminance set point for displaying images on the display screen of the display device 200. As noted above, the white balance set point and/or the luminance set point may be factory default settings provided by the manufacturer of the display device, and/or may be adjustable display configuration settings selectable by a user. In one embodiment, the display configuration settings may be supplied to display controller 250 via data interface 270 and/or via power and control buttons 265. In another embodiment, the display configuration settings may be stored within display controller 250, or within a storage medium 280 coupled to the display controller.

Display controller 250 may be any sub-system component that is capable of performing the operations noted herein for the display controller. For example, display controller may be a programmable integrated circuit, an application specific integrated circuit (ASIC), a field programmable gate array (FPGA), a microcontroller unit (MCU), a central processing unit (CPU) or other processing device. In some embodiments, display controller 250 may comprise, or be configured to execute, software and/or firmware to perform one or more of the operations noted herein.

Display panel 220 may include a variety of different types of display panels including, but not limited to, a light emitting diode (LED) display panel, an organic-LED (OLED) display panel and a liquid crystal display (LCD) panel. For the sake of brevity, display panel 220 is illustrated in FIGS. 2A and 2B as a liquid crystal display (LCD) 222 comprising liquid crystals sandwiched between two glass substrates, each having transparent conducting electrodes (e.g., indium tin oxide, ITO, electrodes) formed thereon. A color filter 224 is formed upon an upper glass substrate of LCD panel 222 to provide a pattern of red, green and blue (RGB) pixels, thereby enabling color display on the LCD panel. Although not shown in FIGS. 2A and 2B, a vertically polarizing film may be formed upon the upper glass substrate to polarize light entering the display, and a horizontally polarizing film may be formed upon the lower glass substrate to block/pass light.

Since LCD panels produce no light on their own, backlight panel 230 is included within the display device 200 to illuminate display panel 220 and produce a visible image on the display panel/display screen of the display device. Although some LCD panels are illuminated with cold cathode fluorescent lamps (CCFL) placed at opposite edges of the display, or arranged as an array of parallel CCFLs, most LCD display devices are now being provided with an LED backlight, instead of the traditional CCFL backlight. Compared to CCFL backlights, LED backlights offer a wider color gamut, produce images with greater dynamic contrast, allow a wider dimming range and can be used to produce very slim display devices. In addition, LED backlights consume less power, have longer lifespans and are generally more reliable than CCFL backlights.

According to one embodiment, LED backlight panel 230 may comprise a serial string of LED emitters (EM) 232 arranged along each side edge of the LCD display screen. The combination of LCD panel 220 and an LED backlight panel 230 having side edge-mounted LEDs results in an edge-lit LCD display device. Many edge-lit LCD display devices comprise a string of white LED emitters 232, which are typically formed by coating a blue LED having a peak emission wavelength of about 450-490 nm with a phosphor (e.g., Yttrium aluminium garnet, YAG). Some edge-lit LCD display devices may comprise a string of RGB LED emitters 232. As shown in FIGS. 2A and 2B, LED backlight panel 230 may include a light guide panel (LGP) 234 or diffuser panel, which is arranged behind LCD 222 for spreading the light emitted by the edge-mounted LED emitters 232 evenly across the LCD 222. The edge-mounted LED emitters 232 are positioned for emitting light into side edges of LGP 234. The emitted light propagates through LGP 234 to evenly distribute the light across the LGP, and is transmitted through a front surface of the LGP for illuminating LCD panel 220. In some cases, a reflector 236 may be disposed behind LGP 234 to help redirect light out of the display device.

An edge-lit LED backlight panel 230, as shown in FIGS. 2A and 2B, is popular in many different types of display devices and information handling systems, since it allows the overall thickness of the display device to be reduced. Although the current design trend is to produce increasingly thinner display devices and systems, LED backlight panel 230 is not strictly limited to the implementation shown in FIGS. 2A and 2B.

According to an alternative embodiment, LED backlight panel 230 may comprise a two-dimensional array of LED emitters (not shown), which is disposed behind LCD 222 and diffuser 234 for providing the illumination necessary to produce visible images or video content on display panel 220. The two-dimensional array may include an array of phosphor-converted white LEDs, an array of RGB LEDs, or an array of RGBW LEDs. LCD panels lit with RGB or RGBW LEDs provide wider color gamuts than those lit with phosphor-converted white LEDs, and therefore, may be preferred in some display devices and information handling systems where wide color gamuts are desired.

Although depicted as an LCD display device, and more specifically, an edge-lit LCD display device in FIGS. 2A and 2B, display device 200 is not strictly limited to such. According to another embodiment, display device 200 may comprise an LED display panel or an organic LED (OLED) display panel, instead of the LCD panel 220 shown in the exemplary embodiments of FIGS. 2A and 2B. Unlike LCD panel 220, an LED or OLED display panel uses an array of light-emitting diodes as pixels for displaying images on the display device. Since LED and OLED display panels provide their own source of illumination, a separate backlight panel 230 is not needed to produce illumination for image display on such display devices.

Although LEDs provide many advantages over other light sources used for illumination within a display device, the color and luminance of the light emitted by currently available LEDs tends to vary with changes in operating conditions (e.g., changes in drive current and junction temperature) and over time, as the LEDs age. For example, the luminous flux output from all LEDs generally decreases with increasing temperature, causing the light output from the display device to appear "dimmer" (i.e., less bright) with increasing LED junction temperature.

The chromaticity of the illumination produced by LEDs also varies with temperature, due to shifts in the dominant wavelength (for both phosphor-converted and non-phosphor converted LEDs) and changes in the phosphor efficiency (for phosphor-converted white LEDs). This change in chromaticity is different for different colors of LEDs. For example, while the peak emission wavelength of green LEDs tends to decrease with increasing junction temperature, the peak emission wavelength of red and blue LEDs tends to increase with increasing junction temperature. Although the change in chromaticity is relatively linear with temperature for most colors, red and yellow LEDs tend to exhibit a more significant non-linear change. This means that when RGB LEDs are combined within a display device, the color point of the illumination produced by the display device may appear increasingly "cooler" as the junction temperature of the LEDs rises. Phosphor converted white LEDs, on the other hand, may appear "cooler" or "warmer" with increasing junction temperature, depending on the peak emission wavelength of the LED and the phosphor used to produce the white LED.

As LEDs age, the luminous flux output from both phosphor-converted and non-phosphor converted LEDs, and the chromaticity of phosphor-converted LEDs, also changes over time. Early on in life, the luminous flux can either increase (get brighter) or decrease (get dimmer), while late in life, the luminous flux generally decreases for all LEDs. As expected, the luminous flux output decreases faster over time when LEDs are subjected to higher drive currents and higher temperatures, often resulting in a noticeably dimmer display device. As a phosphor-converted white LED ages, the phosphor becomes less efficient and the amount of blue light that passes through the phosphor increases. This decrease in phosphor efficiency causes the overall color produced by the phosphor-converted white LED to appear "cooler" over time. Although the dominant wavelength and chromaticity of a non-phosphor converted LED (e.g., a red, green or blue LED) does not change over time, the luminous flux decreases as the LED ages, which in effect causes the chromaticity of light emitted by red, green and blue LEDs to change over time.

It is generally desirable that the light output from a display device (i.e., the light transmitted out of the device through the display screen 210) maintains consistent color and luminance over operating conditions and the lifetime of the display device. In other words, the light output from the display device should not deviate or drift significantly from a reference set point (e.g., a white balance set point, a luminance set point, a red set point, a green set point or a blue set point) during use of the display device, or over time. In LED-illuminated display devices (including LED-illuminated LCD devices, LED display devices and OLED display devices), the LED emitters are responsible for a vast majority of the color and luminance drift (e.g., roughly 90%), while the remaining display panel components (e.g., the LGP 234, LCD 222, color filter 224 and display screen 210 shown in the LCD device embodiments of FIGS. 2A and 2B) contribute to a lesser degree (e.g., roughly 10%).

While prior art display devices and methods have attempted to combat age-related color and luminance drift by simply increasing the drive currents supplied to the LEDs over time, doing so creates additional problems. While it is true that supplying larger drive currents to the LEDs will increase the generated luminous flux, and therefore, the brightness of the display device, larger drive currents inherently result in higher LED temperatures, which affect the chromaticity of the emitted illumination and accelerate LED aging. Therefore, this method alone cannot be used to maintain consistent color and luminance from the LED emitters. This method also cannot be used to account for the color and luminance drift attributable to other display panel components, such as the LGP 234, LCD 222, color filter 224 and display screen 210 shown in the LCD device embodiments of FIGS. 2A and 2B.

As described in more detail below with regard to FIGS. 2-4, the present disclosure provides an improved display device and related methods that may be used to maintain consistent color and luminance of the light output by the display device over changes in operating conditions and lifetime of the display device. Generally speaking, the present disclosure provides a characterization method, which correlates the color/luminance measured from the light emitted by a light source disposed within the display device to the color/luminance measured from the light output from the display device at the time of manufacture. After the display device is characterized and a set of characterization values are stored within the display device (or within the information handling system), a compensation method is used during operation of the display device to perform color/luminance correction for the light output from the display device by repeatedly measuring the color/luminance of the light source illumination, and adjusting color gain values to maintain the color/luminance of the output light at a reference set point. In doing so, the characterization and compensation methods described herein may account for all contributors to color and luminance drift, not just those attributable to the light source (e.g., LED emitters).

Figure 3:
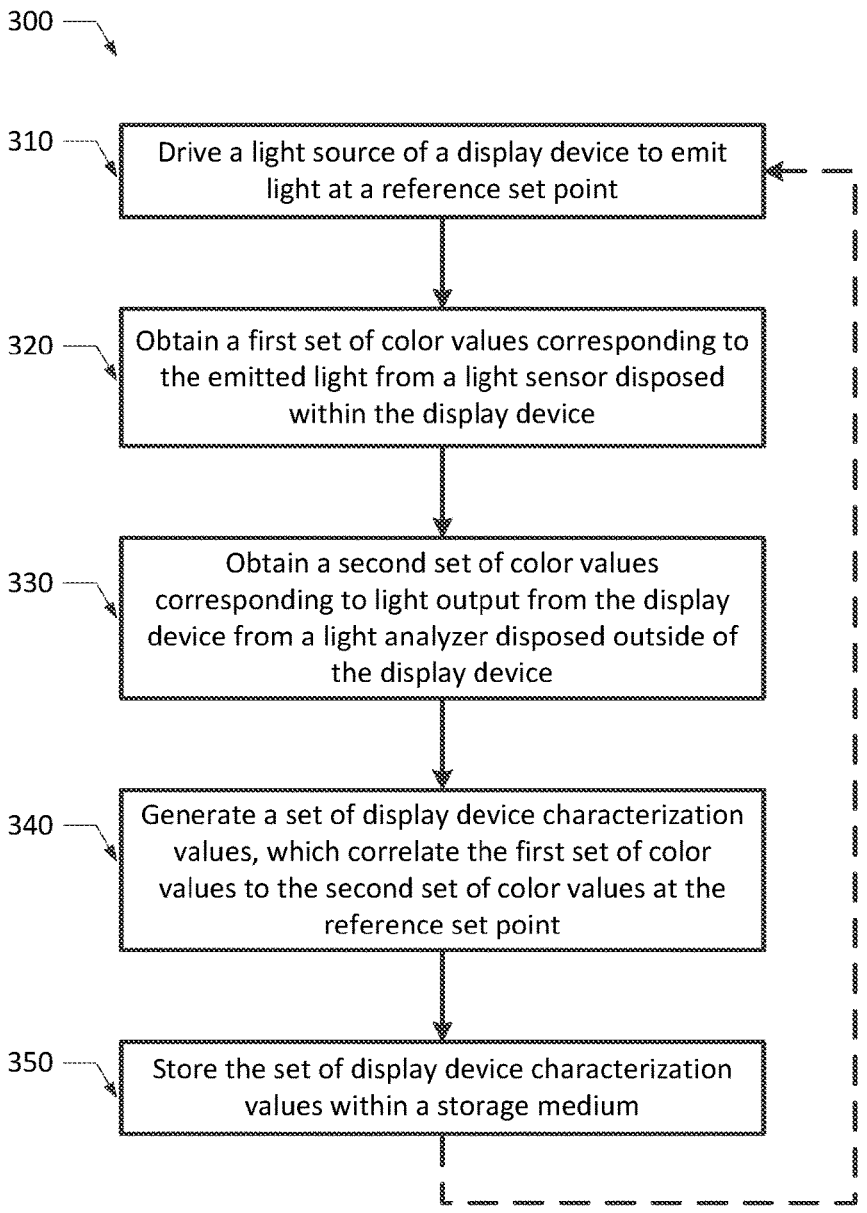
FIG. 3 is a flow chart diagram illustrating one embodiment of a method for characterizing a display device.

FIG. 3 is a flow chart diagram illustrating one embodiment of a method (300) for characterizing a display device, in accordance with the present disclosure. As shown in FIG. 3, the method may generally begin by driving a light source of the display device to emit light at a reference set point (in step 310). In some embodiments, the reference set point may be a white balance set point and/or a luminance set point, which as noted above, may comprise default settings provided by the manufacturer of the display device or user-selectable settings. In other embodiments, the reference set point may comprise a red reference set point, a green reference set point, and/or a blue reference set point.

In the embodiments of FIGS. 2A and 2B, the light source driven to emit light in step 310 comprises edge-mounted phosphor-converted white LED emitters 232, which are driven with drive currents supplied from driver circuitry 240 under the control of display controller 250 to emit light at a reference set point. It is noted, however, that the light source driven to emit light in step 310 is not strictly limited to edge-mounted phosphor-converted white LED emitters. In other embodiments, the light source driven to emit light in step 310 may comprise an alternative arrangement of LED emitters (e.g., a two-dimensional array of LEDs) and/or any alternative light source (e.g., RGB LED emitters, quantum dot LED emitters, etc.) that can be configured to produce white light.

Figure 5:
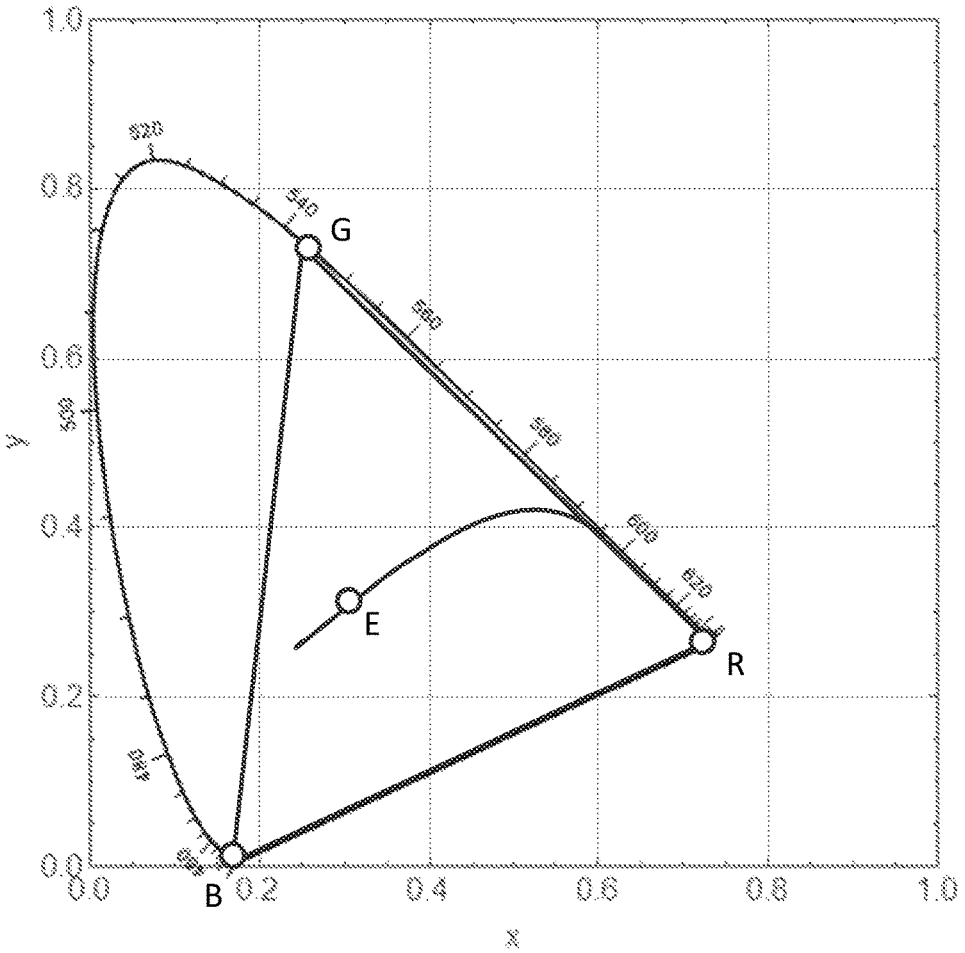
FIG. 5 is a graph of the 1931 CIE xy chromaticity diagram illustrating the gamut of human color perception, and an exemplary RGB color gamut, or RGB color space, overlying a portion of the 1931 CIE xy chromaticity diagram.

FIG. 5 is a graph illustrating the CIE 1931 xy chromaticity diagram showing the location of three exemplary RGB emitters, each having its own chromaticity and spectral wavelength. Depending on how each emitter is driven to emit light, the RGB emitters can be configured to produce any chromaticity within the gamut, or color space, produced by those primary colors, as represented by the triangle connecting the R, G, and B chromaticity coordinates. In some cases, the RGB emitters may be driven to emit white or near-white light at a white balance set point (or simply "white point"). In the CIE 1931 xy chromaticity diagram, "E" denotes the equal energy white point defined by $(x,y)=[\frac{1}{3}, \frac{1}{3}]$. Although the equal energy white point is illustrated in FIG. 5, the RGB emitters may be driven to produce substantially any white point on, or near, the Planckian locus (i.e., the curved line passing through the equal energy white point "E"). Although phosphor-converted white LEDs are restricted to smaller gamuts, they too may be driven to produce a variety of white points on, or near, the Planckian locus.

Once the light source is drive to emit light, method 300 may obtain a first set of color values corresponding to the light emitted by the light source from a light sensor, which is disposed within the display device for receiving the emitted light (in step 320). The first set of color values may be obtained (i.e., directly measured or calculated) in a first color space, including but not limited to, the CIE 1931 XYZ color space, the CIE 1931 xyY color space, the CIE 1931 RGB color space, the CIE 1976 LUV color space, and various other color spaces (e.g., sRGB, adobe RGB, etc.). In the embodiments of FIGS. 2A and 2B, light sensor 290 is disposed behind backlight panel 230 for receiving light that is emitted by LED emitters 232, propagated through LGP 234 and transmitted through one or more gaps or openings formed within reflector 236. In other embodiments, light sensor 290 may be disposed elsewhere within the display device for receiving light emitted from an array of LEDs or an alternative light source.

In some embodiments, a single light sensor 290 may be arranged behind backlight panel 230 near a center point of display panel 220, as shown in FIG. 2A. In other embodiments, the display device may include a plurality of light sensors 290, each arranged behind backlight panel 230 (or an array of LEDs or alternative light source) and centered behind a different section of display panel 220, as shown in FIG. 2B. While including multiple light sensors 290 may increase the complexity and cost of the display device, it may also allow multiple sections of the display device to be independently characterized and controlled, and thus, may be desirable in some embodiments.

In some embodiments, light sensor 290 may be an XYZ tristimulus color sensor (or colorimeter), which is coupled and configured for obtaining a first set of XYZ tristimulus color values from the light emitted by the light source. In one exemplary embodiment, light sensor 290 may be a TCS3430 XYZ tristimulus color sensor from AMS USA Inc.; however, other XYZ tristimulus color sensors obtained from other manufacturers may also be used. An XYZ tristimulus color sensor provides direct measurement of color values in the CIE 1931 XYZ color space, which encompasses all color sensations that an average person can experience. In the CIE 1931 XYZ color space, Y is defined as luminance (i.e., perceived brightness), and the XZ plane is defined as containing all possible (x,y) chromaticities at that luminance.

However, light sensor 290 is not strictly limited to an XYZ tristimulus color sensor, nor is it restricted to measuring XYZ tristimulus color values, in all embodiments. In one alternative embodiment, light sensor 290 may be configured for providing the first set of color values as (x,y) chromaticity coordinates and a Y tristimulus value that is convertible into a set of XYZ tristimulus values. In another alternative embodiment, light sensor 290 may be an RGB color sensor, which is coupled and configured for obtaining a first set of RGB color values from the light emitted by the light source. In most embodiments, however, an XYZ color sensor may be preferred over an RGB color sensor, since an XYZ color sensor provides a direct measurement of real color coordinates and brightness (as opposed to a measurement of mixed RGB color effects), and thus, provides an accurate measurement of color and brightness.

In step 330, method 300 may obtain a second set of color values corresponding to light output from the display device from a light analyzer, which is disposed outside of the display device for receiving the output light. The second set of color values may be obtained (i.e., directly measured or calculated) in a second color space, including but not limited to, the CIE 1931 XYZ color space, the CIE 1931 xyY color space, the CIE 1931 RGB color space, the CIE 1976 LUV color space, and various other color spaces (e.g., sRGB, Adobe RGB, etc.). In some embodiments, light analyzer 205 may be configured for obtaining the second set of color values from the same color space used to obtain the first set of color values. In other embodiments, light analyzer 205 may be configured for obtaining the second set of color values from a second color space, which is different from the first color space.

In the embodiments of FIGS. 2A and 2B, light analyzer 205 is disposed outside of display device 200 for receiving the light output from the display screen 210 of the display device. In one example, light analyzer 205 may be a spectroradiometer or a spectrophotometer, which is coupled for measuring the absolute or relative spectral radiance (intensity) of the output light, and configured for calculating a second set of XYZ tristimulus values for each red, green and blue channel by integrating the values under each spectral curve. One example of a suitable spectroradiometer is the CS-2000 or CS-2000A provided by Konica Minolta. Other light analyzers may be used in other embodiments.

In one alternative embodiment, light sensor 290 and light analyzer 205 may both comprise tristimulus colorimeters for measuring XYZ tristimulus values of the emitted light and the output light, respectively. In another alternative embodiment, light sensor 290 may be tristimulus colorimeter configured for measuring XYZ tristimulus values of the emitted light, and light analyzer 205 may be a spectrocolorimeter coupled for measuring the spectral power distribution of the output light and configured for calculating XYZ tristimulus values corresponding to the measured distribution.

In step 340, method 300 may generate a set of characterization values 345, which correlate the first set of color values to the second set of color values at the reference set point. By correlating the first set of color values to the second set of color values, the set of display device characterization values 345 may be used during a subsequent compensation method (e.g., method 400 shown in FIG. 4) to correct for any color and/or luminance drift attributable to the light source (e.g., light source 232 of FIGS. 2A and 2B) and other display panel components (e.g., LGP 234).

In some embodiments, the set of characterization values 345 may be generated in step 340 by dividing the second set of color values by the first set of color values. According to one embodiment, the set of characterization values 345 may be generated in step 340, as shown in EQ. 1.

$$\begin{pmatrix} R_X & R_Y & R_Z \\ G_X & G_Y & G_Z \\ B_X & B_Y & B_Z \end{pmatrix} = \begin{pmatrix} C_{11} & C_{12} & C_{13} \\ C_{21} & C_{22} & C_{23} \\ C_{31} & C_{32} & C_{33} \end{pmatrix} \times \begin{pmatrix} X & 0 & 0 \\ 0 & Y & 0 \\ 0 & 0 & Z \end{pmatrix} \qquad \text{EQ. 1}$$

In EQ. 1, the XYZ matrix corresponds to the first set of color values obtained from a light sensor disposed within the display device (e.g., light sensor 290), the RGB matrix corresponds to the second set of color values obtained from a light analyzer disposed outside of the display device (e.g., light analyzer 205), and $C_{11} \ldots C_{33}$ correspond to the set of characterization values 345, which correlate the first set of color values to the second set of color values at the reference set point.

Once the set of characterization values 345 are generated in step 340, they may be stored in step 350 for use in a subsequent compensation method. In some embodiments, the set of characterization values may be stored within a storage medium of the display device or the information handling system. In the embodiments of FIGS. 2A and 2B, the set of display device characterization values 345 are stored within storage medium 280 of display device 200, and used by display controller 250 to correct for any color and/or luminance drift that may occur in the output light over operating conditions and over time, as the light source ages.

In some embodiments, steps 310-350 may be performed during manufacturing of the display device (or shortly thereafter) to determine a baseline from which color and luminance can be subsequently corrected to compensate for light source aging and other changes that occur in the output light during use of the display device. In the above described embodiments, this baseline is a set of characterization values, which correlates a first set of color values, which is obtained from a light sensor disposed within the display device in response to light emitted from a light source at a reference set point, to a second set of color values obtained from a light analyzer disposed outside of the display device in response to light output from the display device. In some embodiments, the reference set point may be a white balance set point and/or a luminance (i.e., brightness) set point for displaying images on a display screen of the display device.

In other embodiments, the reference set point may be a red reference set point, a green reference set point and/or a blue reference set point.

In other embodiments, steps 310-350 may be repeated for a plurality of different reference set points, so as to generate and store a set of characterization values within a storage medium of the display device or information handling system for each of the different reference set points. In one such embodiment, steps 310-350 may be repeated for a plurality of different white balance set points and/or luminance set points. Such an embodiment may be desirable if the display device enables the white balance set point and/or the luminance set point to be adjusted, for example, by a user of the display device. In another such embodiment, a display device comprising an RGB light source may be characterized by repeating steps 310-350 at a red reference set point, a green reference set point, and/or a blue reference set point.

Figure 4:
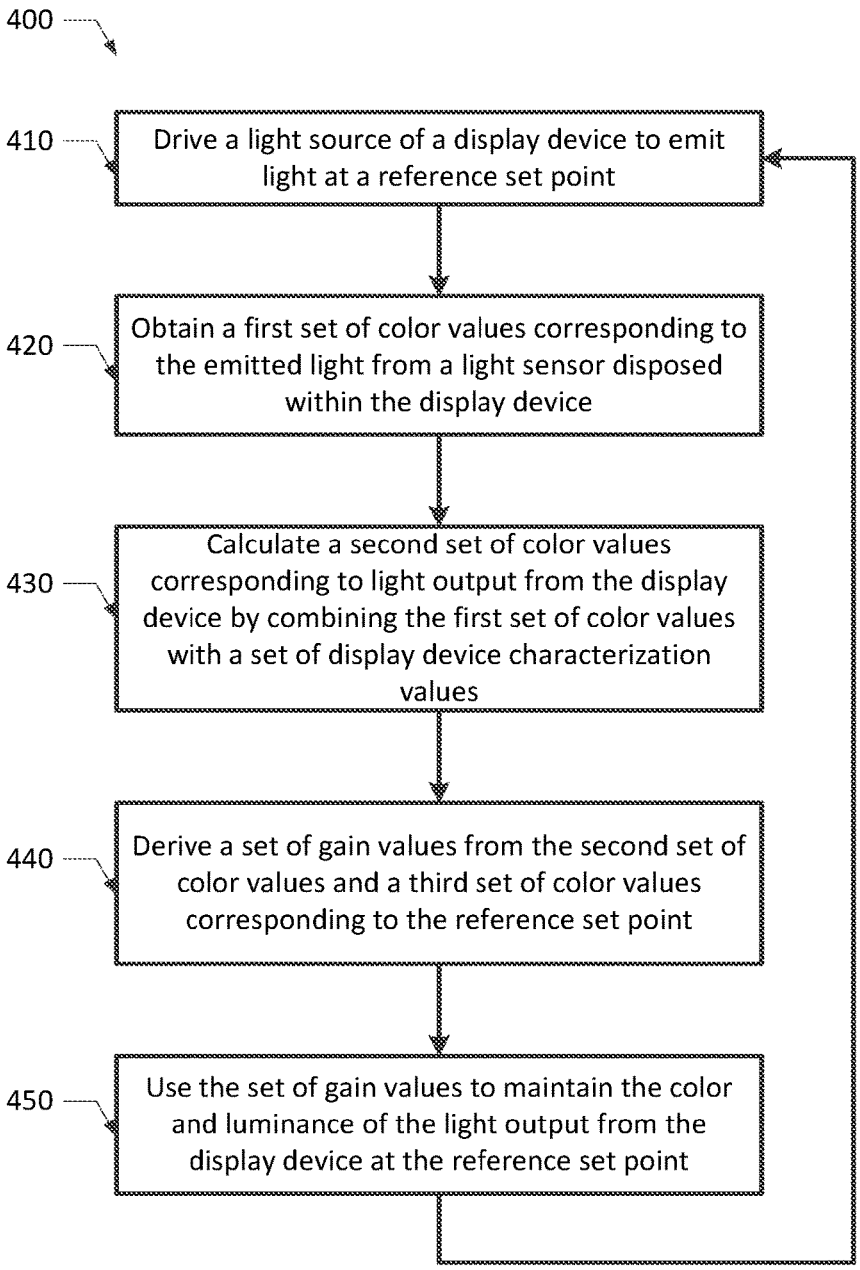
FIG. 4 is a flow chart diagram illustrating one embodiment of a method for maintaining a color and a luminance of light output from a display device over time and other operating conditions.

FIG. 4 is a flow chart diagram illustrating one embodiment of a method (400 that may be used for maintaining a desired color and luminance of the light output from a display device over time and other operating conditions. In some embodiments, method 400 may be performed continuously, at a fixed frequency, during operation of the display device to ensure that a desired color and a desired luminance of the output light is consistently maintained. In other embodiments, the frequency with which method 400 is performed may increase or decrease during use of the display device or over time. For example, the method steps shown in FIG. 4 and described in more detail below may be repeated at a higher frequency while the display device light source is warming up, and at a lower frequency once a steady state is reached. In another example, the method steps shown in FIG. 4 may be repeated at a lower frequency when the display device is relatively new, and at an increasingly greater frequency over the lifetime of the display device as the light source ages. In yet other embodiments, method 400 may be initially performed one or more times upon start-up of the display device, and may be repeated after a steady state is reached only upon detecting a change in one or more parameters associated with the light source (e.g., a change in the LED junction temperature or forward voltage), or upon detecting a change in the color or luminance of the light output from the display device. In these latter embodiments, additional sensors, circuitry and/or program instructions may be included within and/or outside of the display device to detect such changes and respond thereto.

As shown in FIG. 4, method 400 may generally begin by driving a light source of the display device to emit light at a reference set point (in step 410). In some embodiments, the reference set point may be a white balance set point and/or a luminance set point, which as noted above, may be default settings provided by the manufacturer of the display device or user-selectable settings. In other embodiments, the reference set point may be a red reference set point, a green reference set point and/or a blue reference set point.

In the embodiments of FIGS. 2A and 2B, the light source driven to emit light in step 410 comprises edge-mounted phosphor-converted white LED emitters 232, which are driven with drive currents supplied from driver circuitry 240 under the control of display controller 250. It is noted, however, that the light source driven to emit light in step 410 is not strictly limited to edge-mounted phosphor-converted white LED emitters, and may comprise an alternative arrangement of LED emitters (e.g., a two-dimensional array of LEDs) and/or any alternative light source (e.g., RGB LED emitters, quantum dot LED emitters, etc.) that can be configured to produce white light.

Once the light source is driven to emit light, method 400 may obtain a first set of color values corresponding to the light emitted by the light source from a light sensor, which is disposed within the display device for receiving the emitted light (in step 420). The first set of color values may be obtained (i.e., directly measured or calculated) in a first color space, including but not limited to, the CIE 1931 XYZ color space, the CIE 1931 xyY color space, the CIE 1931 RGB color space, the CIE 1976 LUV color space, and various other color spaces (e.g., sRGB, Adobe RGB, etc.). In the embodiments of FIGS. 2A and 2B, light sensor 290 is disposed behind backlight panel 230 for receiving light that is emitted by LED emitters 232, propagated through LGP 234 and transmitted through one or more gaps or openings formed within reflector 236. In other embodiments, light sensor 290 may be disposed elsewhere within the display device for receiving light emitted from an array of LED emitters or an alternative light source.

As noted above, light sensor 290 may be a single light sensor 290, which is arranged behind backlight panel 230 near a center point of display panel 220, or may comprise a plurality of light sensors 290, each arranged behind backlight panel 230 and centered behind a different section of display panel 220. Although light sensor 290 may be configured for obtaining the first set of color values within substantially any color space, light sensor 290 may be an XYZ tristimulus color sensor, in at least one embodiment. As noted above, an XYZ tristimulus color sensor may be preferred due to its ability to generate accurate measurements of real color and intensity.

In step 430, method 400 calculates a second set of color values corresponding to a predicted light output from the display device. In other words, a light sensor or light analyzer will typically not be disposed outside of the display device for measuring light output during user operation of the display device. Therefore, method 400 computes a predicted light output in step 430 by combining the first set of color values obtained in step 420 with the set of characterization values 345, which were generated at the time of manufacturing and stored within the display device or the information handling system for later use. In the embodiments shown in FIGS. 2A and 2B, display controller 250 calculates the second set of color values by multiplying the first set of color values obtained from light sensor 290 in step 420 with the set of characterization values 345 stored, for example, within storage medium 280.

According to one embodiment, the second set of color values corresponding to the predicted light output from the display device may be calculated in step 430 by multiplying the first set of color values with the set of characterization values, as shown in EQ. 2.

$$\begin{pmatrix} R'_X & R'_Y & R'_Z \\ G'_X & G'_Y & G'_Z \\ B'_X & B'_Y & B'_Z \end{pmatrix} = \begin{pmatrix} C_{11} & C_{12} & C_{13} \\ C_{21} & C_{22} & C_{23} \\ C_{31} & C_{32} & C_{33} \end{pmatrix} \times \begin{pmatrix} X' & 0 & 0 \\ 0 & Y' & 0 \\ 0 & 0 & Z' \end{pmatrix} \quad \text{EQ. 2}$$

In EQ. 2, the X'Y'Z' matrix corresponds to the first set of color values obtained from the internal light sensor (e.g., light sensor 290) in step 420, $C_{11} \ldots C_{33}$ correspond to the set of characterization values 345 that were generated and stored in method 300, and the R'G'B' matrix corresponds to the second set of color values, which correspond to the predicted light output from the display device. By multiplying the first set of color values (X'Y'Z') obtained from the internal light sensor in step 420 with the stored set of characterization values ($C_{11} \ldots C_{33}$), EQ. 2 can be used to predict the light output from the display device.

In step 440, method 400 derives a set of gain values that may be used to compensate or correct for the color/luminance drift of the light output from the display device. According to one embodiment, a set of gain values may be derived in step 440 by combining the second set of color values calculated in step 430 with a third set of color values corresponding to the reference set point, as shown in EQ. 3.

$$\begin{pmatrix} W_X \\ W_Y \\ W_Z \end{pmatrix} = \begin{pmatrix} R'_X & G'_X & B'_X \\ R'_Y & G'_Y & B'_Y \\ R'_Z & G'_Z & B'_Z \end{pmatrix} \times \begin{pmatrix} R'_{gain} \\ G'_{gain} \\ B'_{gain} \end{pmatrix} \quad \text{EQ. 3}$$

In EQ. 3, the R'G'B' matrix corresponds to the second set of color values calculated in step 430, the $W_X W_Y W_Z$ matrix corresponds to the third set of color values corresponding to the reference set point (e.g., a white balance set point), and $R'_{gain}$, $G'_{gain}$, and $B'_{gain}$ correspond to the RGB gain values derived in step 440. In the embodiments shown in FIGS. 2A and 2B, display controller 250 may derive the set of gain values by dividing the third set of color values by the second set of color values, or by multiplying the third set of color values by the inverse of the second set of color values, as shown in EQ. 4.

$$\begin{pmatrix} R'_{gain} \\ G'_{gain} \\ B'_{gain} \end{pmatrix} = \begin{pmatrix} R'_X & G'_X & B'_X \\ R'_Y & G'_Y & B'_Y \\ R'_Z & G'_Z & B'_Z \end{pmatrix}^{-1} \times \begin{pmatrix} W_X \\ W_Y \\ W_Z \end{pmatrix} \quad \text{EQ. 4}$$

In step 450, the RGB gain values derived in step 440 are used to maintain the color and luminance of the light output from the display device at the reference color set point (e.g., the white balance set point, $W_X W_Y W_Z$). In the embodiments shown in FIGS. 2A and 2B, display controller 250 may use the RGB gain values to modify the current amplitude, or the pulse-width-modulation (PWM) duty cycle, of the drive signal supplied to light source 232 via driver circuitry 240, as well as the drive signal supplied to LCD panel 222.

As noted above, method steps 410-450 may be repeated over the lifetime of the display device to maintain consistent color/luminance of the light output from the display device at the reference set point. In some embodiments, the reference set point may be changed to a new reference set point (e.g., a new white balance set point), and steps 410-450 may be repeated to change the color and the luminance of the light output from the display device to the new reference set point.

According to one embodiment, the characterization method 300 shown in the flow chart diagram of FIG. 3 and the compensation method 400 shown in flow chart diagram of FIG. 4 may be embodied, at least in part, in a computer readable storage medium containing computer readable code, such that a series of steps are performed when the computer readable code is executed on a processing device. The computer readable storage medium may comprise substantially any non-transitory computer readable storage medium, including but not limited to, a direct access storage device (e.g., a hard disk drive), random access memory (RAM), read-only memory (ROM), electrically erasable programmable read-only memory (EEPROM), and/or flash memory. The computer readable code, or program instructions, used to implement the methods described herein may be written in any combination of one or more programming languages, including an object oriented programming language, without limitation. These computer program instructions may be provided to a processing device of a display device or information handling system, such as a display controller, CPU, GPU, or another programmable data processing apparatus to produce a machine, such that the program instructions, which execute via the processor of the display device or information handling system, performs the methods described herein.

In some embodiments, the computer readable code or program instructions used to implement characterization method 300 and compensation method 400 may be stored within a computer readable storage medium (e.g., storage medium 280) and may be executed by a display controller (e.g., display controller 250) or other processing unit of a display device (e.g., display device 200). Although illustrated in FIGS. 2A and 2B as residing outside of display controller 250, storage medium 280 may alternatively reside within display controller 250. In other embodiments, the computer readable code or program instructions used to implement characterization method 300 and compensation method 400 may be stored within a computer readable storage medium (e.g., memory 120 or NVRAM 150) and may be executed by a processing device (e.g., CPU 110 or GPU 140) of the information handling system (e.g., system 100 of FIG. 1). In such embodiments, data and/or control signals may be supplied to the display controller 250 of the display device (via data interface 270) for performing certain steps of the methods shown in FIGS. 3 and 4.

While the present disclosure may be adaptable to various modifications and alternative forms, specific embodiments have been shown by way of example and described herein. However, it should be understood that the present disclosure is not intended to be limited to the particular display device, information handling system and/or methods disclosed and illustrated herein. Rather, the present disclosure is intended to cover all modifications, equivalents, and alternatives falling within the spirit and scope of the present disclosure as defined by the appended claims.

In some implementations, certain steps of the methods described herein may be combined, performed simultaneously or in a different order, or perhaps omitted, without deviating from the scope of the disclosure. Thus, while the method steps are described and illustrated in a particular sequence, use of a specific sequence of steps is not meant to imply any limitations on the disclosure. Changes may be made with regards to the sequence of steps without departing from the spirit or scope of the present disclosure. Use of a particular sequence of steps is therefore, not to be taken in a limiting sense, and the scope of the present disclosure is defined only by the appended claims. Furthermore, certain changes may be made with regard to the display device and/or the information handling system without departing from the spirit or scope of the present disclosure. For example, the display device may be configured with a light source, display panel and/or light sensor different from those described and illustrated herein. Thus, the present disclosure is not limited to only those embodiments shown and described herein, and may include other embodiments and/or combinations of embodiments.

What is claimed is:

1. A method for characterizing a display device, the method comprising:

driving a light source of the display device to emit light at a reference set point;

obtaining a first set of color values corresponding to the light emitted by the light source, wherein the first set of color values are obtained from a light sensor disposed within the display device for receiving the emitted light;

obtaining a second set of color values corresponding to light output from the display device, wherein the second set of color values are obtained from a light analyzer disposed outside of the display device for receiving the output light;

generating a set of display device characterization values, which correlate the first set of color values to the second set of color values obtained at the reference set point; and storing the set of display device characterization values within a storage medium of the display device.

2. The method as recited in claim 1, wherein the steps of driving a light source, obtaining a first set of color values, obtaining a second set of color values, generating a set of display device characterization values and storing the set of display device characterization values are performed during manufacturing of the display device.

3. The method as recited in claim 1, wherein the first set of color values comprises XYZ tristimulus values, and wherein the second set of color values comprise XYZ tristimulus values.

4. The method as recited in claim 1, wherein the first set of color values comprises RGB color values, and wherein the second set of color values comprises RGB color values.

5. The method as recited in claim 1, wherein the step of generating a set of display device characterization values comprises dividing the second set of color values by the first set of color values.

6. The method as recited in claim 1, wherein the reference set point comprises a white balance set point, a red set point, a green set point or a blue set point.

7. The method as recited in claim 1, further comprising repeating the steps of driving a light source, obtaining a first set of color values, obtaining a second set of color values, generating a set of display device characterization values and storing the set of display device characterization values for a plurality of different reference set points.

8. A method for maintaining a color and a luminance of light output from a display device over time, the method comprising:

driving a light source of the display device to emit light at a reference set point;

obtaining a first set of color values corresponding to the light emitted by the light source, wherein the first set of color values are obtained from a light sensor disposed within the display device for receiving the emitted light;

calculating a second set of color values corresponding to the light output from the display device by combining the first set of color values with a stored set of display device characterization values;

deriving a set of gain values from the second set of color values and a third set of color values, which corresponds to the reference set point; and using the set of gain values to maintain the color and the luminance of the light output from the display device at the reference set point.

9. The method as recited in claim 8, wherein the steps of driving, obtaining, calculating, deriving and using are performed repeatedly over time during operation of the display device to maintain the color and the luminance of the light output from the display device at the reference set point.

10. The method as recited in claim 8, wherein the reference set point comprises a white balance set point, a red set point, a green set point or a blue set point.

11. The method as recited in claim 8, further comprising changing the reference set point to a new reference set point, and repeating the steps of driving, obtaining, calculating, deriving and using to change the color and the luminance of the light output from the display device to the new reference set point.

12. The method as recited in claim 8, wherein the first set of color values comprises XYZ tristimulus values, and wherein the second set of color values comprise XYZ tristimulus values.

13. The method as recited in claim 8, wherein the first set of color values comprises RGB color values, and wherein the second set of color values comprises RGB color values.

14. The method as recited in claim 8, wherein the stored set of display device characterization values comprises values, which were previously determined during manufacturing of the display device and stored within a storage medium of the display device.

15. The method as recited in claim 14, wherein the stored set of display device characterization values were previously determined by dividing a fifth set of color values by a fourth set of color values, wherein the fourth set of color values were previously obtained from the light sensor disposed within the display device upon receiving light emitted from the light source at the reference set point, and wherein the fifth set of color values were previously obtained from a light analyzer disposed outside of the display device for receiving light output from the display device.

16. A system, comprising:

a light source configured to emit light at a reference set point;

a light sensor coupled to receive the emitted light and configured to generate a first set of color values corresponding to the emitted light;

a processing device coupled to receive the first set of color values from the light sensor, and configured to:

calculate a second set of color values corresponding to light output from the system by combining the first set of color values with a stored set of characterization values; and derive a set of gain values from the second set of color values and a third set of color values, which corresponds to the reference set point; and driver circuitry coupled to the light source and to the processing device, wherein the driver circuitry is configured to use the set of gain values to alter a drive signal supplied to the light source, so as to maintain a color and a luminance of the light output from the system at the reference set point.

17. The system as recited in claim 16, wherein the system comprises a display device, which includes a display panel arranged above the light source for receiving the emitted light and for generating images for display on a display screen of the display device.

18. The system as recited in claim 17, wherein the light sensor is arranged behind the light source near a center point of the display panel.

19. The system as recited in claim 17, further comprising a plurality of light sensors, each arranged behind the light source and centered behind a different section of the display panel.

20. The system as recited in claim 16, further comprising a storage medium containing the stored set of characterization values, which were previously determined during manufacturing of the system.

* * * * *